US012710035B2

(12) United States Patent
Belshan et al.

(10) Patent No.: US 12,710,035 B2
(45) Date of Patent: Aug. 18, 2026

(54) CONTROLLING SUCTION VALVES OF A FLUID PUMP

(71) Applicant: SPM Oil & Gas Inc., Fort Worth, TX (US)

(72) Inventors: Daryl James Belshan, Weatherford, TX (US); Wesley P Clark, Weatherford, TX (US); Ralph Harris, Fort Worth, TX (US); Chandu Kumar, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 1 day.

(21) Appl. No.: 18/958,571

(22) Filed: Nov. 25, 2024

(65) Prior Publication Data

US 2026/0146602 A1 May 28, 2026

(51) Int. Cl.
*F04B 53/10* (2006.01)
*F04B 49/24* (2006.01)

(52) U.S. Cl.
CPC ..... *F04B 53/1032* (2013.01); *F04B 49/243* (2013.01); *F04B 2201/06011* (2013.01)

(58) Field of Classification Search
CPC .... F04B 53/10; F04B 53/1032; F04B 49/243; F04B 49/22; F04B 49/225; F04B 7/0076; F04B 19/22; F04B 1/0421; F04B 2201/06011
See application file for complete search history.

(56) References Cited

U.S. PATENT DOCUMENTS

| | | | | |
|---|---|---|---|---|
| 2,171,171 | A | 8/1939 | Brauer | |
| 3,847,511 | A | 11/1974 | Cole | |
| 11,415,123 | B2 * | 8/2022 | Hunter | F04B 53/10 |
| 11,506,189 | B2 | 11/2022 | Bridges | |
| 11,739,748 | B2 * | 8/2023 | Hurst | F04B 53/1087 417/451 |
| 11,952,986 | B2 * | 4/2024 | Nowell | F04B 23/06 |
| 2010/0183448 | A1 * | 7/2010 | Leugemors | F04B 49/22 417/53 |
| 2019/0186478 | A1 * | 6/2019 | Cappelli | F04B 27/02 |
| 2019/0323497 | A1 * | 10/2019 | Raskar | F04B 23/04 |
| 2020/0208628 | A1 | 7/2020 | Sigmar et al. | |
| 2025/0163784 | A1 * | 5/2025 | Clyburn | E21B 43/121 |

FOREIGN PATENT DOCUMENTS

| | | | |
|---|---|---|---|
| DE | 29 34 476 | A1 | 3/1981 |
| JP | 3739430 | B2 | 1/2006 |
| KR | 101731482 | B1 | 5/2017 |
| RU | 2466297 | C2 | 11/2012 |

* cited by examiner

*Primary Examiner* — Dapinder Singh

(57) ABSTRACT

A suction valve control system of a fluid pump, that is configured to discharge fluid during a plurality of discharge cycles, may include a plurality of suction valves for respective cylinders of a fluid end of the fluid pump. The plurality of suction valves may be configured to close during the plurality of discharge cycles in accordance with a normal operation of the plurality of suction valves. The suction valve control system may include a controller configured to cause, responsive to a deactivating event for a cylinder of the respective cylinders, a suction valve of the cylinder to be maintained in an open position throughout one or more discharge cycles of the plurality of discharge cycles, while at least one other suction valve of the plurality of suction valves has the normal operation during the one or more discharge cycles.

20 Claims, 5 Drawing Sheets

CONTROLLING SUCTION VALVES OF A FLUID PUMP

TECHNICAL FIELD

The present disclosure relates generally to fluid pumps and, for example, to controlling suction valves of a fluid pump.

BACKGROUND

Large pumps are commonly used in oil and gas extraction applications. For example, a high-pressure reciprocating pump may be suitable for uses relating to hydraulic fracturing, well cementing, or well drilling. These large pumps may use poppet-style valves that open and close by differential pressure across the valves. The valves allow flow of a fluid into a fluid chamber to be compressed, and flow out from the fluid chamber when an internal pressure exceeds a working discharge pressure. A pump that generates high discharge pressures may employ multiple cylinders, each cylinder including a fluid chamber controlled by valves. During the operation of the pump, a component of a cylinder (e.g., a suction valve, a discharge valve, a packing, etc.) may fail or otherwise exhibit defectiveness (e.g., leaking). In such cases, the pump is shut down to allow for replacement of the defective component, and sometimes the replacement of associated components that are otherwise operational. This leads to excessive repairing of the pump and significant unplanned pump downtime.

The suction valve control system of the present disclosure solves one or more of the problems set forth above and/or other problems in the art.

SUMMARY

A suction valve control system of a fluid pump, that is configured to discharge fluid during a plurality of discharge cycles, may include a plurality of suction valves for respective cylinders of a fluid end of the fluid pump. The plurality of suction valves may be configured to close during the plurality of discharge cycles in accordance with a normal operation of the plurality of suction valves. The suction valve control system may include a controller configured to cause, responsive to a deactivating event for a cylinder of the respective cylinders, a suction valve of the cylinder to be maintained in an open position throughout one or more discharge cycles of the plurality of discharge cycles, while at least one other suction valve of the plurality of suction valves has the normal operation during the one or more discharge cycles.

A method may include monitoring, by a controller, an operating parameter relating to a fluid pump. The fluid pump may be configured to discharge fluid during a plurality of discharge cycles. The fluid pump may have a plurality of suction valves for respective cylinders of a fluid end of the fluid pump. The plurality of suction valves may be configured to close during the plurality of discharge cycles in accordance with a normal operation of the plurality of suction valves. The method may include causing, by the controller and responsive to the operating parameter being indicative of a defect associated with a component of a cylinder of the respective cylinders, a suction valve of the cylinder to be maintained in an open position throughout one or more discharge cycles of the plurality of discharge cycles, while at least one other suction valve of the plurality of suction valves has the normal operation during the one or more discharge cycles.

A fluid pump system may include a fluid pump configured to discharge fluid during a plurality of discharge cycles. The fluid pump may include a fluid end having a plurality of suction valves for respective cylinders of the fluid end. The plurality of suction valves may be configured to close during the plurality of discharge cycles in accordance with a normal operation of the plurality of suction valves. The fluid pump system may include a controller configured to monitor an operating parameter relating to the fluid pump, and cause, responsive to the operating parameter being indicative of a defect associated with a component of a cylinder of the respective cylinders, termination of discharge flow from the cylinder during one or more discharge cycles of the plurality of discharge cycles, while discharge flow from at least one other cylinder of the respective cylinders is maintained during the one or more discharge cycles.

DETAILED DESCRIPTION

This disclosure relates to a suction valve control system, which is applicable to any fluid pump that employs a suction valve configured to open by differential pressure of fluid. For example, the fluid pump may be a positive displacement pump, such as a reciprocating pump.

Figure 1:
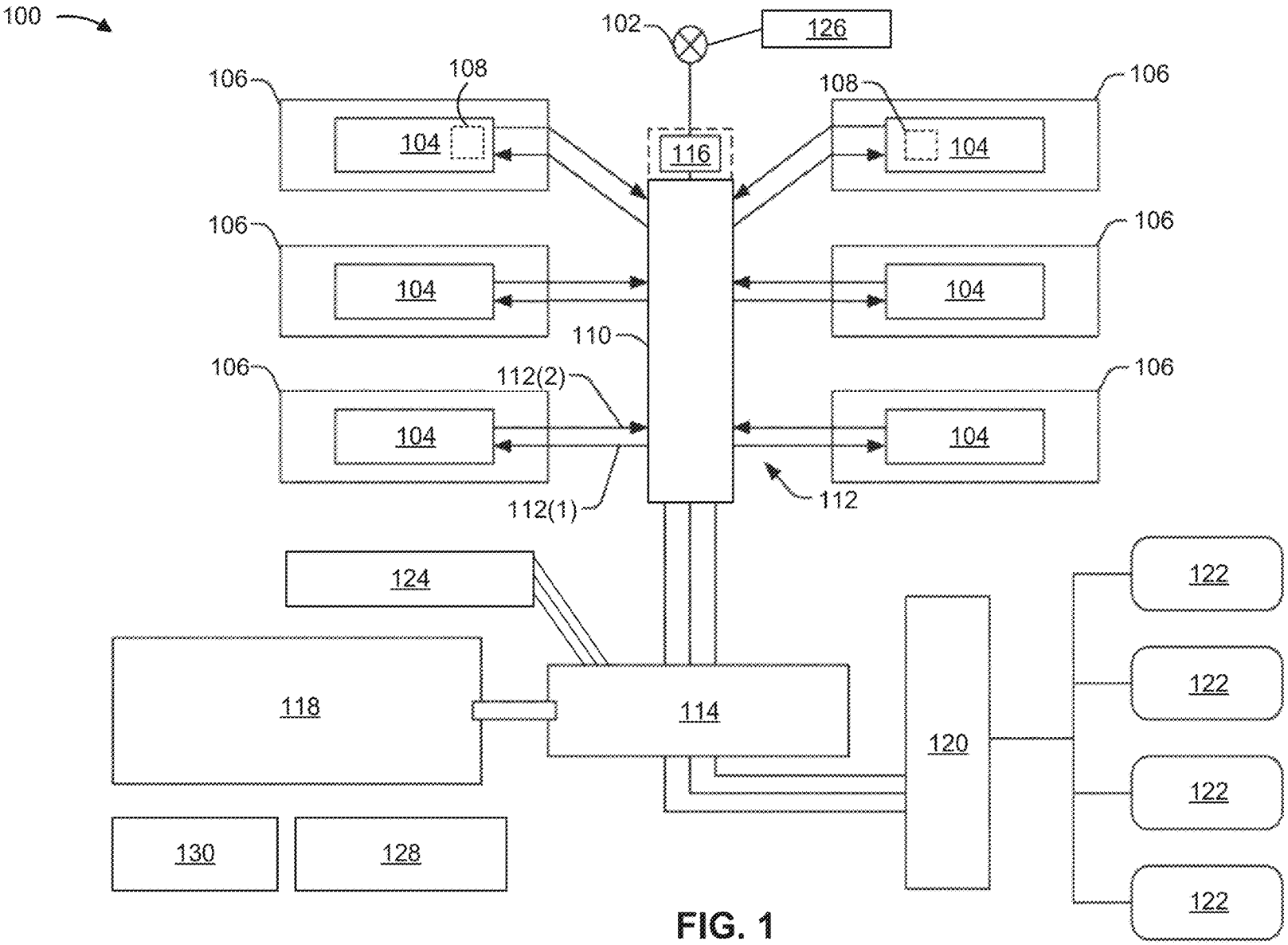
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid, which may be received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120, or alternatively a chemical adding unit or the blender 114, may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100.

As indicated above, FIG. 1 is provided as an example. Other examples may differ from what is described with regard to FIG. 1.

Figure 2:
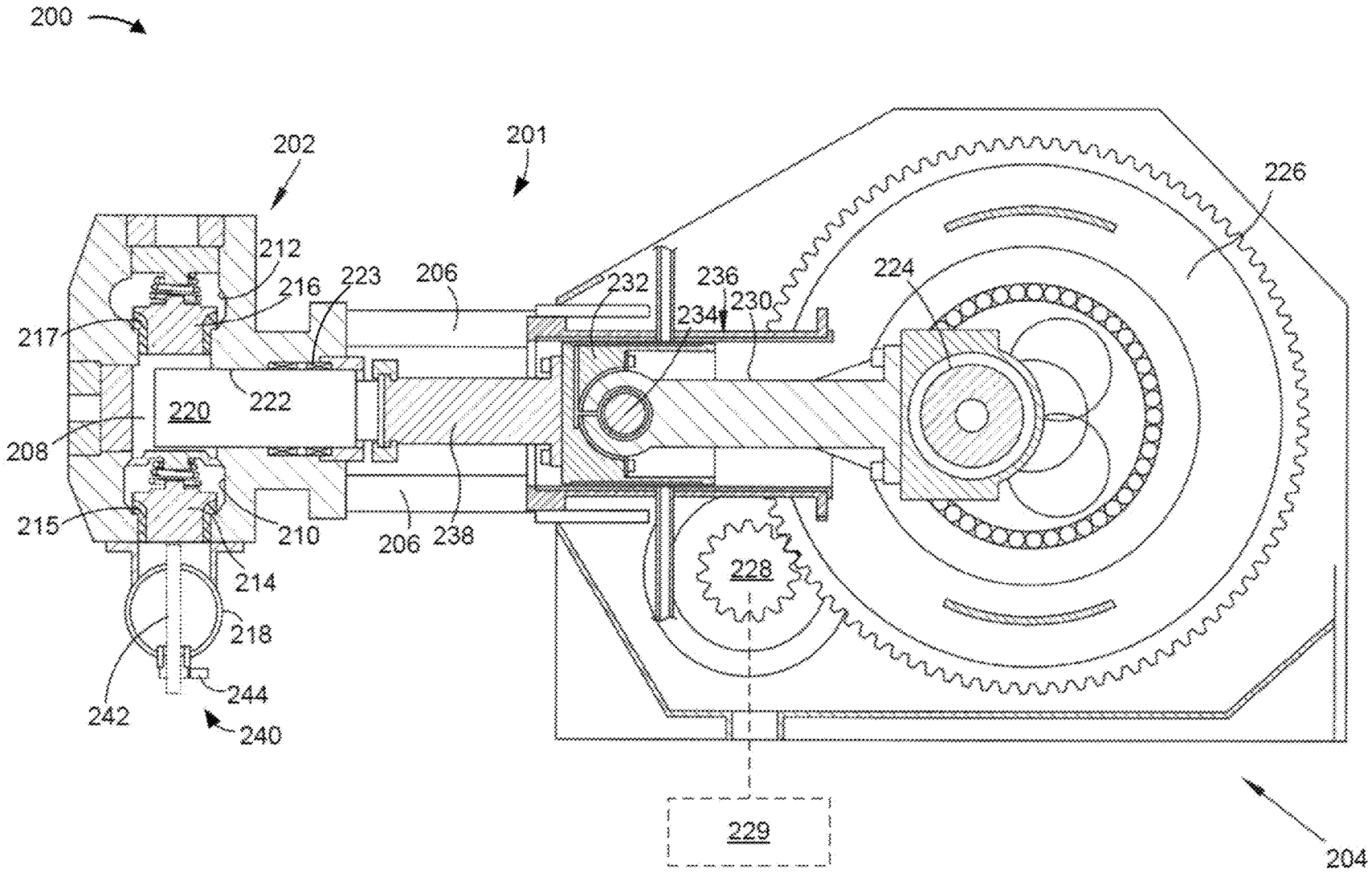
FIGS. 2-3 are diagrams illustrating a sectional view of an example fluid pump system.
Figure 3:
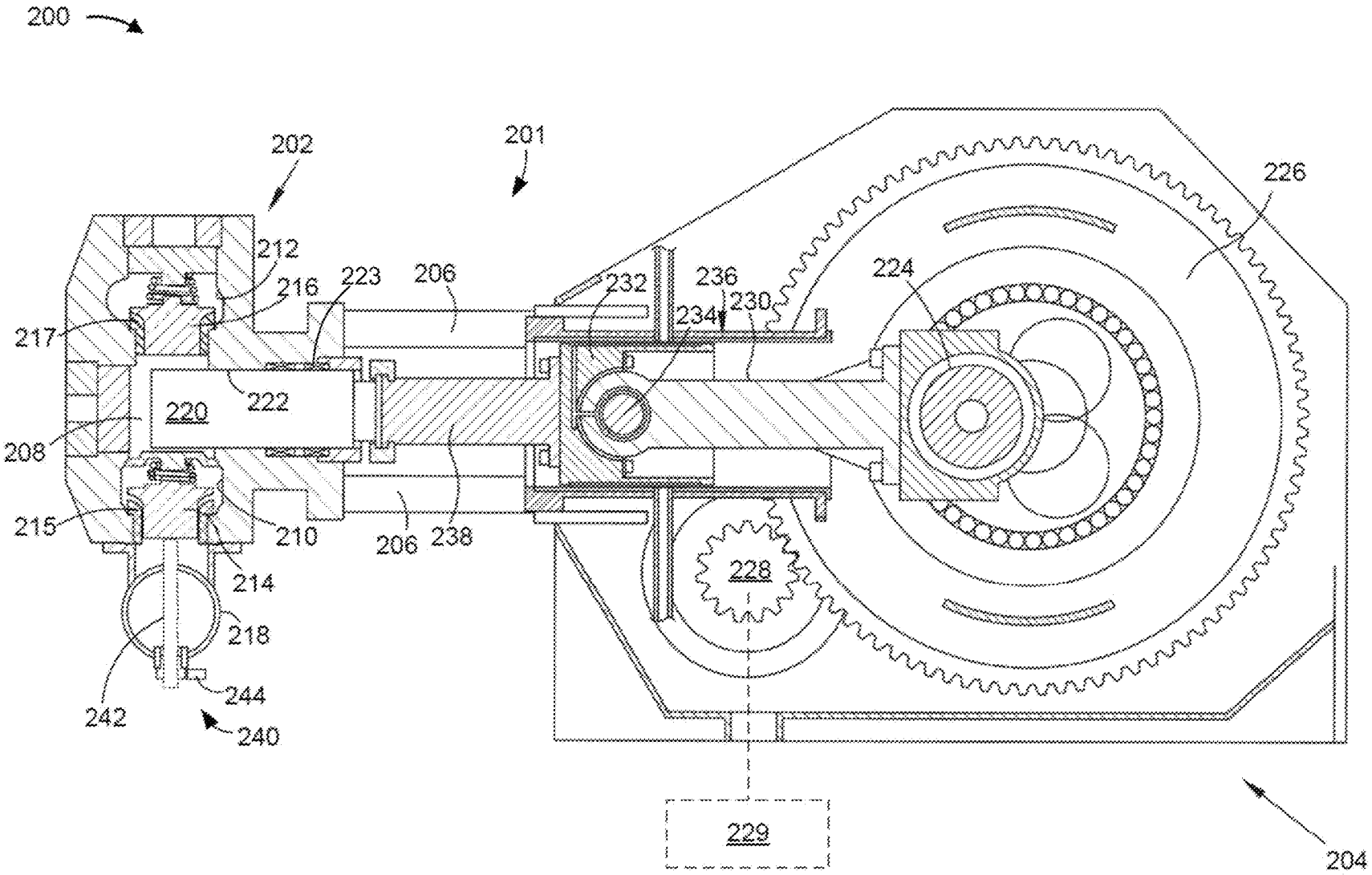

FIGS. 2-3 are diagrams illustrating a sectional view of an example fluid pump system 200. The fluid pump system 200 includes a fluid pump 201 (e.g., a fluid pump assembly) and a suction valve control system 240. The fluid pump 201 may be configured to operate in an application relating to oil and gas extraction, such as hydraulic fracturing, well cementing, and/or well drilling, among other examples. In some implementations, the fluid pump 201 may be mounted on a trailer to facilitate transportation of the fluid pump 201 between operational sites. The fluid pump 201 may be a positive displacement pump. For example, the fluid pump 201 may be a reciprocating pump, as shown.

In some implementations, the fluid pump 201 may have a capability to produce a maximum discharge pressure of at least 10,000 pounds per square inch (psi), at least 15,000 psi, or at least 20,000 psi. For example, the fluid pump 201 may be a hydraulic fracturing pump (e.g., the fluid pump 201 may correspond to the fluid pump 108). In some implementations, the fluid pump 201 may have a capability to produce a maximum discharge pressure of at most 7,500 psi, at most 5,000 psi, or at most 1,000 psi. For example, the fluid pump 201 may be a cement pump (e.g., configured to pump cement), a mud pump (e.g., configured to pump drilling fluid, also known as "drilling mud"), and/or an injection pump (e.g., configured to pump water and/or chemicals for injection to a well), among other examples.

The fluid pump 201 includes a fluid end 202 and a power end 204. The fluid end 202 may be connected to the power end 204 by stay rods 206. The fluid end 202 includes one or more fluid chambers 208 (only one shown). For example, the fluid pump 201 may include one, two, three, four, five, or more fluid chambers 208 and associated components. A fluid chamber 208 may sometimes be referred to as a "bore" of the fluid pump 201.

The fluid pump 201 may be configured to allow fluid to flow into the fluid chamber 208 during suction cycles of the fluid pump 201, and to discharge fluid during discharge cycles of the fluid pump 201. The fluid pump 201 includes a suction valve 214, disposed within a suction bore 210, that is configured to control fluid suction into the fluid chamber 208. The suction valve 214 (e.g., a poppet-style valve) may be biased (e.g., by a spring) to a closed position with respect to a suction valve seat 215 (thereby creating a seal) in the fluid chamber 208. For example, the suction valve 214 may be configured to close during discharge cycles of the fluid pump 201 in accordance with a normal operation of the suction valve 214. Similarly, the fluid pump 201 includes a discharge valve 216, disposed within a discharge bore 212, that is configured to control fluid discharge from the fluid chamber 208. The discharge valve 216 (e.g., a poppet-style valve) may be biased (e.g., by a spring) to a closed position with respect to a discharge valve seat 217 (thereby creating a seal) in the fluid chamber 208. During a suction stroke of a plunger 220, fluid is allowed to flow from a suction manifold 218 through the suction valve 214 and into the fluid chamber 208. The fluid is then pumped in response to a discharge stroke (e.g., a forward stroke) of the plunger 220 and flows through the discharge valve 216 into the discharge bore 212. The discharge bore 212 may be fluidly coupled to a wellbore or other destination to supply high pressure fluid.

In operation, the reciprocating plunger 220 moves in a plunger bore 222, which may include a packing 223 surrounding the plunger 220, and is driven by the power end 204 of the fluid pump 201. The power end 204 may include a crankshaft 224 that is rotated by a gearbox output 226 (illustrated by a single gear, but may be more than one gear). A gearbox input 228 may be coupled to a transmission (not shown) and/or a prime mover 229 to rotate the gearbox input 228 during operation. In some implementations, the gearbox input 228 may be coupled directly to the prime mover 229 without use of a transmission.

As one example, the prime mover 229 may include a reciprocating engine, which may be configured to drive the power end 204 without use of a transmission. As another example, the prime mover 229 may include a gas engine (also referred to as a "natural gas engine" or a "gaseous fuel engine"), which may be configured to operate at constant speed. As an additional example, the prime mover 229 may include a turbine engine, such as a single-shaft turbine engine or a dual-shaft turbine engine. In some implementations, the prime mover 229 may include an electric motor, such as a direct current (DC) electric motor or an alternating current (AC) electric motor. The electric motor may be configured to drive the power end 204 with or without control by a variable frequency drive (e.g., at constant speed). As a further example, the prime mover 229 may include a diesel engine, which may be configured to drive the power end 204 using a transmission.

A connecting rod 230 mechanically connects the crankshaft 224 to a crosshead 232 via a wrist pin 234. The crosshead 232 is mounted within a stationary crosshead housing 236, which constrains the crosshead 232 to linear reciprocating movement. A pony rod 238 connects to the crosshead 232 and has its opposite end connected to the plunger 220 to enable reciprocating movement of the plunger 220 (e.g., the plunger 220 is operably connected to the power end 204). The plunger 220 may be one of a plurality of plungers, such as, for example, three or five plungers, depending on the size of the fluid pump 201 (e.g., three cylinder, five cylinder, etc.) and the number of fluid chambers 208.

The plunger 220 extends through the plunger bore 222 so as to interface and otherwise extend within the fluid chamber 208. In operation, movement of the crankshaft 224 causes the plunger 220 to reciprocate within, or move linearly toward and away from, the fluid chamber 208. As the plunger 220 translates away from the fluid chamber 208 (a suction stroke of the plunger 220), the pressure of the fluid inside the fluid chamber 208 decreases, which creates a pressure differential across the suction valve 214. The pressure differential across the suction valve 214 enables actuation (e.g., opening) of the suction valve 214 to allow the fluid to enter the fluid chamber 208 from the suction manifold 218 (e.g., the fluid is pressurized to a low pressure, such as from 60 to 100 psi, by an outside system, such as a centrifugal pump, and pushed through the suction manifold 218). The pumped fluid is pushed into the fluid chamber 208 as the plunger 220 continues to translate away from the fluid chamber 208. As the plunger 220 changes directions and moves toward the fluid chamber 208 (a discharge stroke of the plunger 220), the fluid pressure inside the fluid chamber 208 increases, which creates a pressure differential across the discharge valve 216. Fluid pressure inside the fluid chamber 208 continues to increase as the plunger 220 approaches the fluid chamber 208 until the pressure differential across the discharge valve 216 is great enough to actuate (e.g., open) the discharge valve 216 and enable the fluid to exit the fluid chamber 208.

As an example, at top dead center (TDC) of the plunger 220 (when the plunger 220 is furthest from the crankshaft 224 center line, and volume in the fluid chamber 208 is at a minimum), pressure in the fluid chamber 208 is at, or is close to, a discharge pressure of the fluid pump 201. As the plunger 220 moves away from TDC, both the discharge valve 216 and the suction valve 214 may be closed, and pressure drops as volume in the fluid chamber 208 increases. The relationship between pressure and volume when the discharge valve 216 and the suction valve 214 are closed is defined largely by the compressibility of a fluid being pumped. When the pressure in the fluid chamber 208 is near, or is below, a suction pressure, the suction valve 214 opens, and flow begins to enter the fluid chamber 208 (e.g., while the plunger 220 is still moving away from TDC). The rate of flow into the fluid chamber 208 is related to the speed of the plunger 220. At about 80 degrees from TDC, when the crankshaft 224 is at 90 degrees to the centerline of the connecting rod 230, plunger velocity and suction flow rate are at a maximum. As the plunger 220 moves toward bottom dead center (BDC) of the plunger 220 (volume in the fluid chamber 208 is at a maximum), the plunger velocity and suction valve flow rate approaches zero. The suction valve 214 may close at this point, or slightly after when the plunger 220 begins to travel back towards TDC. As the plunger 220 moves toward TDC, both the suction valve 214 and the discharge valve 216 may be closed, and pressure increases in the fluid chamber 208 as volume is decreased. The discharge valve 216 opens when the pressure in the fluid chamber 208 is at, or slightly exceeds, the discharge pressure of the discharge bore 212. Flow may leave the fluid chamber 208 during the period when the discharge valve 216 opens and then closes, near or slightly after when the plunger 220 is back at TDC.

The suction valve control system 240 may include one or more valve control components 242 and a controller 244. A valve control component 242 is configured to control actuation of a suction valve 214, which may include controlling closing of the suction valve 214, controlling opening of the suction valve 214, and/or controlling lift (e.g., a maximum lift) of the suction valve 214. For example, the valve control component 242 is configured to restrict ordinary closing (e.g., ordinary closing due to a biasing member and/or pressurization of the fluid chamber 208) of the suction valve 214 in a controlled manner (e.g., the valve control component 242 may be configured to hold open the suction valve 214 and to release the suction valve 214 according to a desired timing). In one example, the valve control component 242 may include an actuator (e.g., a plunger-type actuator) that is hydraulically controlled (e.g., by a solenoid valve), or electronically and/or mechanically controlled. The actuator may be configured to actuate between a retracted position and an extended position, and, in some examples, to intermediate positions between the retracted position and the extended position. The actuator may be positioned such that in an extended position, the actuator can reach the underside of the suction valve 214 (e.g., the side of the suction valve 214 opposite the fluid chamber 208) when the suction valve 214 is in an open position. Alternatively, the actuator may be attached to the suction valve 214. In some examples, the valve control component 242 may include a physical part that is configured to directly contact a surface of the suction valve 214 in order to hold open the suction valve 214. The valve control component 242 is not limited to any particular type of actuator, physical part, and/or actuation mechanism described herein. The suction valve control system 240 may include a respective valve control component 242 for each suction valve 214 of the fluid pump 201. Phase between the valve control components 242 and the plunger 220 may be established from a timing wheel or a phase marker on the fluid pump 201, which can be correlated to control signals for the valve control components 242.

In FIG. 2, the valve control component 242 is shown not holding open the suction valve 214, and the suction valve 214 is in a closed position. In FIG. 3, the valve control component 242 is shown holding the suction valve 214 in an open position.

The controller 244 may include one or more memories and one or more processors communicatively coupled to the one or more memories. A processor may include a central processing unit, a graphics processing unit, a microprocessor, a controller, a microcontroller, a digital signal processor, a field-programmable gate array, an application-specific integrated circuit, and/or another type of processing component. The processor may be implemented in hardware, firmware, or a combination of hardware and software. The processor may be capable of being programmed to perform one or more operations or processes described elsewhere herein. A memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may be a non-transitory computer-readable medium. The memory may store information, one or more instructions, and/or software (e.g., one or more software applications) related to the operation of the controller 244.

The controller 244 may be mounted on the fluid pump 201, the fluid end 202, the suction manifold 218, another component of the fluid pump system 200, or the prime mover 229. Alternatively, the controller 244 may be remote from the fluid pump 201 or the prime mover 229. The controller 244 is communicatively coupled to the valve control components 242. The controller 244 may control a timing at which the valve control components 242 restrict closing of the suction valves 214 (e.g., the controller 244 may control a timing of actuation of the actuators controlling the suction valves 214). Operations described herein as being performed by the controller 244 may be performed by (e.g., split among) multiple controllers (e.g., a first controller may determine the timing and provide instructions to an additional controller that controls the valve control components 242).

The controller 244 may be communicatively coupled to one or more sensors on the fluid pump 201 (e.g., a pressure sensor or a flow rate sensor, among other examples) and/or communicatively coupled to one or more additional controllers associated with the fluid pump 201 and/or the prime mover 229. Thus, the controller 244 may receive input data from the sensor(s) and/or the additional controller(s), and the controller 244 may control a timing of the valve control components 242 (e.g., individually or in unison) in accordance with the input data. The input data may relate to various operating parameters relating to the fluid pump 201 and/or the prime mover 229.

For example, the input data may indicate a type of prime mover, a prime mover output speed, a prime mover available torque, a prime mover actual torque, a prime mover quick to neutral indication (e.g., an indication that the prime mover 229 should be immediately relieved of all output load), a transmission output speed, a transmission output torque, a transmission quick to neutral indication (e.g., an indication that the transmission should be immediately put in neutral), a pump crankshaft speed, a pump crankshaft angle, a pump plunger(s) location, a power end vibration, a fluid end vibration, a pump discharge pressure, a pump required input torque, a pump suction pressure, a pump lube oil pressure, a pump lube oil temperature, a fluid end valve leak detection indication, a fluid end packing leak detection indication, a desired pump flow indicated using an input device or determined automatically (e.g., using a machine learning model), a pump output torque, a pump flow, a quantity of pump plungers, a plunger size (e.g., a configured variable), a pump stroke (e.g., a configured variable), a pump rod load (e.g., calculated from plunger size and discharge pressure), and/or a pump displacement (e.g., calculated from pump stroke, plunger size, and quantity of plungers), among other examples. In some examples, the input data may include available torque of the prime mover and pump required input torque, and the suction valve control system 240 is configured to maintain (e.g., constantly, at least during a certain portion of operation such as start-up) pump required input torque at or below available torque of the prime mover 229. In some examples, the input data may include pump discharge pressure and pump flow, and the suction valve control system 240 is configured to determine pump required input torque based on pump discharge pressure and pump flow. In some examples, the input data may include pump discharge pressure and pump crankshaft speed, and the suction valve control system 240 is configured to determine pump required input torque based on pump discharge pressure and pump crankshaft speed. In some examples, the input data may include pump output torque and pump flow, and the suction valve control system 240 is configured to determine pump required input torque based on pump output torque and pump flow. In some examples, the input data may include pump output torque and pump crankshaft speed, and the suction valve control system 240 is configured to determine pump required input torque based on pump output torque and pump crankshaft speed. The exemplary input data described above, provided to the suction valve control system 240, can enable balancing of pump required input torque with available torque of the prime mover that solves one or more of the problems set forth herein and/or other problems in the art.

As indicated above, FIGS. 2-3 are provided as an example. Other examples may differ from what is described with regard to FIGS. 2-3.

Figure 4:
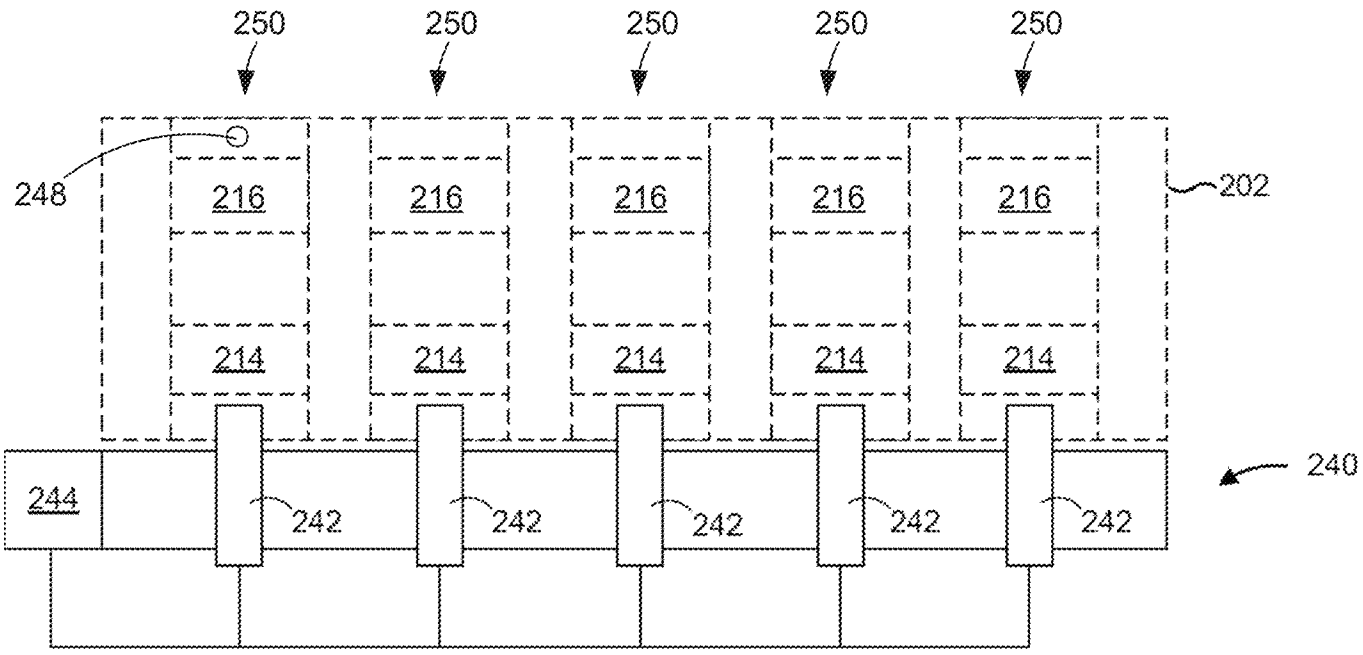
FIG. 4 is a diagram illustrating an example of a suction valve control system.

FIG. 4 is a diagram illustrating an example of the suction valve control system 240. As shown in FIG. 4, and described herein, the suction valve control system 240 may include a plurality of suction valves 214 for respective cylinders 250 of the fluid end 202, a plurality of valve control components 242 for respective suction valves 214, and the controller 244. The suction valve control system 240 is shown with five valve control components 242, each to control a respective suction valve 214. However, the suction valve control system 240 may include a different quantity of valve control components 242, depending on a quantity of suction valves 214 (corresponding to a quantity of fluid chambers 208 and cylinders 250) of the fluid end 202. A cylinder 250 may refer to a section of the fluid end 202 that encompasses a fluid chamber 208, a suction valve 214 and associated suction valve assembly components, a discharge valve 216 and associated discharge valve assembly components, a plunger bore 222 and associated components (e.g., a packing 223, a packing nut, etc.), and/or a plunger 220 for a single pumping mechanism of the fluid end 202.

The controller 244 is configured to perform operations relating to control of the valve control components 242 to provide variable displacement of the fluid pump 201. The controller 244 may perform the operations to achieve deactivation of one or more cylinders 250 of the fluid pump 201 while a remainder of the cylinders 250 remain operational.

The controller 244 may monitor one or more operating parameters relating to the fluid pump 201. For example, the controller 244 may obtain data relating to the operating parameters from one or more sensors 248 on the fluid pump 201. The operating parameters may include a discharge pressure, a packing pressure, a packing temperature, a crankshaft speed, and/or a vibration level of the fluid pump 201, among other examples (e.g., including any of the input data to the controller 244 described herein). The controller 244 may monitor the operating parameters to detect a deactivating event, which is an event when a cylinder 250 should be deactivated (e.g., to avoid an unsafe condition, to prevent damage, to reduce leaking, to maintain discharge pressure, or the like), as described herein. "Deactivation" of the cylinder 250 may refer to terminating discharge flow from the cylinder 250.

Prior to the deactivating event, the controller 244 may cause, during one or more discharge cycles of the fluid pump 201, one or more suction valves 214 (e.g., all of the suction valves 214) not to be maintained in the open position during any portion of the discharge cycles. For example, the controller 244 may deactivate one or more valve control components 242 (e.g., all of the valve control components 242) to cause the suction valves 214 not to be maintained in the open position. Causing the suction valves 214 not to be maintained in the open position may include allowing unrestricted operation of the suction valves 214 in accordance with the normal operation of the suction valves 214 (e.g., the suction valves 214 may be allowed to open and close normally due to a biasing member and/or pressure differential).

Thereafter, the controller 244 may detect a deactivating event. In some implementations, based on monitoring the operating parameters, the controller 244 may determine that an operating parameter (e.g., a measurement relating to the operating parameter) is indicative of a defect (e.g., leaking) associated with a component of a cylinder 250 (e.g., a suction valve 214, a discharge valve 216, a packing 223, a plunger 220, or the like), where the deactivating event may be determining that the operating parameter is indicative of the defect. For example, the defect may be a leaking suction valve 214 and/or discharge valve 216 (e.g., due to wear or damage on the valve face or the valve seat), leaking at the packing 223 (e.g., due to improper compression of the packing 223 and/or wear or damage to the packing 223), damage to the plunger 220, proppant build-up in the cylinder 250, or a crack in a fluid end block at the cylinder 250, among other examples.

In some examples, the controller 244 may detect that measurements of the operating parameter exhibit a particular signature or anomaly that indicates the defect of the component of the cylinder 250. As an example, the deactivating event may be the discharge pressure exhibiting anomalies indicative of the defect, such as pulses, which can be correlated to the cylinder 250 using a timing wheel or phase marker. As another example, the deactivating event may be the vibration level exhibiting a particular signature (e.g., vibration spikes) indicative of the defect. As a further example, the deactivating event may be the crankshaft speed exhibiting anomalies indicative of the defect, such as speed or timing changes, which can be correlated to the cylinder 250 using a timing wheel or phase marker. As an additional example, the deactivating event may be the packing pressure in the cylinder 250 satisfying a threshold or the packing temperature in the cylinder 250 satisfying a threshold. Any of the aforementioned thresholds may be a static value, or may be a dynamic value that changes with changes to one or more of the operating parameters.

In some implementations, the controller 244 may receive an indication, based on a user input, that the cylinder 250 is to be deactivated, where the deactivating event may be receiving the indication. The user input may be made via a button, a touchscreen display, a remote control device, a user device, or the like. For example, the user input may cause the indication (e.g., a deactivation signal) to be sent to, or to be generated by, the controller 244.

Responsive to the deactivating event, the controller 244 may cause the termination of discharge flow from the cylinder 250 associated with the defective component throughout one or more discharge cycles of the fluid pump 201, while discharge flow from at least one other cylinder 250 is maintained during the discharge cycles. For example, responsive to the deactivating event, the controller 244 may cause, such as by using a valve control component 242 associated with the cylinder 250, the suction valve 214 of the cylinder 250 to be maintained in an open position (e.g., the suction valve 214 is held open) throughout one or more discharge cycles of the fluid pump 201. For example, the suction valve 214 may be maintained in the open position for one or more discharge cycles until the end of a hydraulic fracturing stage is reached, until a pump speed is reduced to zero, until an operator acknowledges that the defect has been serviced, or the like. The controller 244 may cause the suction valve 214 of the cylinder 250 to be maintained in the open position during the discharge cycles while at least one other suction valve 214 of another cylinder 250 has a normal operation during the discharge cycles. In other words, the cylinder 250 associated with the defective component may be deactivated (e.g., by maintaining its suction valve 214 in the open position), while the remaining cylinders 250 continue their normal operation (e.g., by allowing their suction valves 214 to operate normally).

Thus, causing the suction valve 214 to be maintained in the open position may cause the termination of discharge flow from the cylinder 250 (e.g., while discharge flow from other cylinders is maintained). The controller 244 may cause the suction valve 214 to be maintained in the open position while the prime mover 229 is in a non-stationary state. The open position of the suction valve 214 may correspond to an opening of the suction valve 214 during suction cycles (e.g., steady state suction cycles) of the fluid pump 201. For example, the open position of the suction valve 214 may be a full open position that corresponds to a maximum flow area of the suction valve 214.

In some implementations, the controller 244 may cause the suction valve 214 to be maintained in the open position during a discharge cycle of the fluid pump 201 and during a suction cycle of the fluid pump 201. Alternatively, the controller 244 may cause the suction valve 214 to be maintained in the open position during a discharge cycle of the fluid pump 201, but may allow the suction valve 214 to operate normally during a suction cycle of the fluid pump 201 (e.g., the controller 244 may cause the suction valve 214 not to be maintained in the open position during the suction cycle). In some implementations, upon the deactivating event, if the suction valve 214 is currently open (e.g., during a suction cycle), then the controller 244 may cause the suction valve 214 to be maintained in that open position, and if the suction valve 214 is currently closed (e.g., during a discharge cycle), then the controller 244 may cause the suction valve 214 to be forced into the open position or may wait until the suction valve 214 opens during a subsequent suction cycle.

The controller 244 may issue activation signals to a valve control component 242 associated with the suction valve 214 (e.g., to a solenoid valve of the valve control component 242) to cause the valve control component 242 to maintain the suction valve 214 in the open position. In some examples, to cause the valve control component 242 to maintain the suction valve in the open position, the controller 244 may cause actuation of the valve control component 242 (e.g., a plunger-type actuator) to an extended position such that the valve control component 242 holds open the suction valve 214 (e.g., by contacting, or pushing against, the underside of the suction valve 214, or based on attachment of the valve control component 242 to the suction valve 214).

By activating the valve control component 242, the suction valve 214, that would otherwise close during discharge cycles of the fluid pump 201, is restricted from closing during the discharge cycles by the valve control component 242. As a result, a discharge stroke of a plunger 220 into a fluid chamber 208 of the cylinder 250 will result in fluid being pumped through the open suction valve 214 back out into the suction manifold 218, rather than pressurizing the fluid sufficiently to open a discharge valve 216 of the fluid chamber 208. In this way, the cylinder 250 may be rapidly deactivated while the remaining cylinders 250 remain active and produce discharge flow. "Discharge cycle" may refer to a discharge stroke of the plunger 220, regardless of whether the discharge stroke discharges fluid from the fluid pump 201.

As indicated above, FIG. 4 is provided as an example. Other examples may differ from what is described with regard to FIG. 4.

Figure 5:
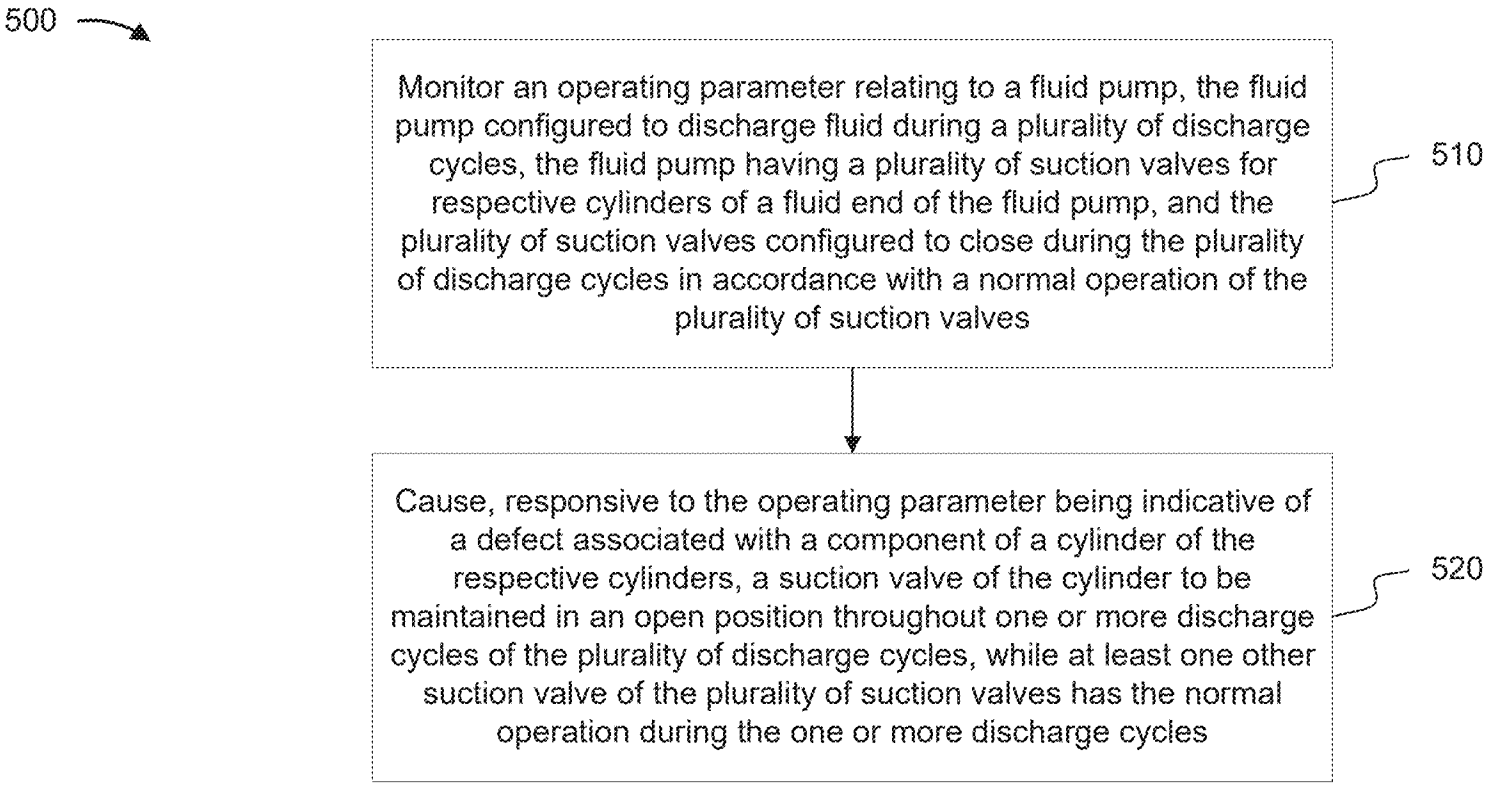
FIG. 5 is a flowchart of an example process 500 associated with controlling suction valves of a fluid pump.

FIG. 5 is a flowchart of an example process 500 associated with controlling suction valves of a fluid pump. One or more steps of FIG. 5 may be performed by a controller (e.g., controller 244). Additionally, or alternatively, one or more steps of FIG. 5 may be performed by another device or a group of devices separate from or including the controller, such as another device or component that is internal or external to the fluid pump system 200.

Process 500 may include, at step 510, monitoring (e.g., using sensor 248, and/or a processor and/or a memory of the controller 244) an operating parameter relating to the fluid pump 201. As described herein, the fluid pump 201 may be configured to discharge fluid during a plurality of discharge cycles, the fluid pump 201 may have a plurality of suction valves 214 for respective cylinders 250 of a fluid end 202 of the fluid pump 201, and the plurality of suction valves 214 may be configured to close during the plurality of discharge cycles in accordance with a normal operation of the plurality of suction valves 214.

Process 500 may include, at step 520, causing (e.g., using a valve control component 242, and/or a processor, a memory, and/or an output component of the controller 244), responsive to the operating parameter being indicative of a defect associated with a component of a cylinder 250 of the respective cylinders 250, a suction valve 214 of the cylinder 250 to be maintained in an open position throughout one or more discharge cycles of the plurality of discharge cycles, while at least one other suction valve 214 of the plurality of suction valves 214 has the normal operation during the one or more discharge cycles. In some examples, step 520 may be performed responsive to a user input indicating that the cylinder 250 is to be deactivated.

Although FIG. 5 shows example steps of process 500, in some implementations, process 500 may include additional steps, fewer steps, different steps, or differently arranged steps than those depicted in FIG. 5. Additionally, or alternatively, two or more of the steps of process 500 may be performed in parallel.

INDUSTRIAL APPLICABILITY

The suction valve control system 240 described herein may be used with any fluid pump that employs a suction valve configured to open by differential pressure of fluid. For example, the suction valve control system 240 may be used with a positive displacement pump, such as a reciprocating pump. In particular, the suction valve control system 240 may be employed in a fluid pump used in an application relating to oil and gas extraction, such as hydraulic fracturing, well cementing, and/or well drilling, among other examples. For example, a fluid pump that uses the suction valve control system 240 may be a hydraulic fracturing pump, a cement pump, a mud pump, or an injection pump, among other examples. During the operation of the pump, a component of a cylinder of the pump may fail or otherwise exhibit defectiveness (e.g., leaking). Generally, in such cases, the pump is shut down to allow for replacement of the defective component, and sometimes the replacement of associated components that are otherwise operational. This leads to excessive repairing of the pump and significant pump downtime.

The suction valve control system 240 described herein enables manipulation of the ordinary (e.g., differential-pressure-based) closing of suction valves of a fluid pump. For example, rather than allowing the suction valves to close naturally at the start of a discharge cycle of the fluid pump, the suction valve control system 240 may hold open the suction valves throughout the discharge cycle. While the suction valves are held open, fluid is pumped through the open suction valves back out into a suction manifold, rather than being pressurized sufficiently to exit through discharge valves of the fluid pump.

Accordingly, when a defect is detected for a component of a cylinder of the pump (e.g., leaking), a suction valve of the cylinder may be held open to deactivate the cylinder (e.g., terminate discharge flow from the cylinder), while a remainder of the cylinders remain operational. In this way, effective use of the pump may continue despite the defect in the cylinder, thereby reducing repairing of the pump and pump downtime.

The foregoing describes only some embodiments, and alterations, modifications, additions and/or changes can be made thereto without departing from the scope and spirit of the disclosed embodiments, the embodiments being illustrative and not restrictive. Furthermore, implementations are not limited to the disclosed embodiments, and may cover various modifications and equivalent arrangements included within the spirit and scope of the disclosed embodiments. Also, the various embodiments described above may be implemented in conjunction with other embodiments, for example, aspects of one embodiment may be combined with aspects of another embodiment to realize yet other embodiments. Further, each independent feature or component of any given assembly or process may constitute an additional embodiment. As used herein, the singular forms of "a," "an," and "the" include plural referents unless the context clearly dictates otherwise. In addition, as used herein, the term "or" means "and/or" unless the context clearly dictates otherwise.

When "a controller" or "one or more controllers" is described or claimed (within a single claim or across multiple claims) as performing multiple operations or being configured to perform multiple operations, unless described or claimed otherwise (e.g., via the use of "first controller" and "second controller" or other language that differentiates controllers) this language is intended to cover a single controller performing or being configured to perform all of the operations, a group of controllers collectively performing or being configured to perform all of the operations, a first controller performing or being configured to perform a first operation and a second controller performing or being configured to perform a second operation, or any combination of controllers performing or being configured to perform the operations.

What is claimed is:

1. A suction valve control system of a fluid pump that is configured to discharge fluid during a plurality of discharge cycles, the suction valve control system comprising:

a plurality of suction valves for respective cylinders of a fluid end of the fluid pump, the plurality of suction valves configured to close during the plurality of discharge cycles in accordance with a normal operation of the plurality of suction valves; and a controller configured to:

monitor, using a sensor of the fluid pump, measurements of an operating parameter relating to the fluid pump;

detect, based on monitoring the measurements of the operating parameter, that the measurements of the operating parameter exhibit a signature or an anomaly indicative of a defect;

correlate, based on the measurements of the operating parameter, the defect to a cylinder of the respective cylinders using a timing wheel or a phase marker; and cause a suction valve of the cylinder to be maintained in an open position throughout one or more discharge cycles of the plurality of discharge cycles, while at least one other suction valve of the plurality of suction valves has the normal operation during the one or more discharge cycles.

2. The suction valve control system of claim 1, wherein the open position of the suction valve corresponds to an opening of the suction valve during a plurality of suction cycles of the fluid pump.

3. The suction valve control system of claim 1, wherein the controller is further configured to:

cause, during one or more prior discharge cycles of the plurality of discharge cycles prior to the deactivating event, the suction valve not to be maintained in the open position during any portion of the one or more prior discharge cycles.

4. The suction valve control system of claim 1, wherein the open position is a full open position that corresponds to a maximum flow area of the suction valve.

5. The suction valve control system of claim 1, further comprising a valve control component configured to control actuation of the suction valve.

6. The suction valve control system of claim 5, wherein the controller, to cause the suction valve to be maintained in the open position, is configured to:

cause the valve control component to maintain the suction valve in the open position.

7. The suction valve control system of claim 6, wherein the controller, to cause the valve control component to maintain the suction valve in the open position, is configured to:

cause actuation of the valve control component to an extended position to hold open the suction valve.

8. The suction valve control system of claim 1, wherein the signature or the anomaly indicative of the defect comprises at least one of:

pulses in discharge pressure of the fluid pump, spikes in vibration of the fluid pump, or speed changes of a crankshaft of the fluid pump.

9. A method, comprising:

monitoring, by a controller and using a sensor, measurements of an operating parameter relating to a fluid pump, the fluid pump configured to discharge fluid during a plurality of discharge cycles, the fluid pump having a plurality of suction valves for respective cylinders of a fluid end of the fluid pump, and the plurality of suction valves configured to close during the plurality of discharge cycles in accordance with a normal operation of the plurality of suction valves;

detecting, by the controller and based on monitoring the measurements of the operating parameter, that the measurements of the operating parameter exhibit a signature or an anomaly indicative of a defect;

correlating, by the controller and based on the measurements of the operating parameter, the defect to a cylinder of the respective cylinders using a timing wheel or a phase marker; and causing, by the controller, a suction valve of the cylinder to be maintained in an open position throughout one or more discharge cycles of the plurality of discharge cycles, while at least one other suction valve of the plurality of suction valves has the normal operation during the one or more discharge cycles.

10. The method of claim 9, wherein the suction valve is to be maintained in the open position throughout the one or more discharge cycles to cause termination of discharge flow from the cylinder.

11. The method of claim 9, wherein the operating parameter is at least one of a discharge pressure, a packing pressure, a packing temperature, a crankshaft speed, or a vibration level.

12. The method of claim 9, wherein the component is the suction valve, a discharge valve of the cylinder, or a packing of the cylinder.

13. The method of claim 9, wherein causing the suction valve to be maintained in the open position comprises:

causing a valve control component to maintain the suction valve in the open position.

14. The method of claim 13, wherein causing the valve control component to maintain the suction valve in the open position comprises:

causing actuation of the valve control component to an extended position to hold open the suction valve.

15. The method of claim 9, wherein the signature or the anomaly indicative of the defect comprises at least one of:

pulses in discharge pressure of the fluid pump, spikes in vibration of the fluid pump, or speed changes of a crankshaft of the fluid pump.

16. A fluid pump system, comprising:

a fluid pump configured to discharge fluid during a plurality of discharge cycles, comprising:

a fluid end having a plurality of suction valves for respective cylinders of the fluid end, the plurality of suction valves configured to close during the plurality of discharge cycles in accordance with a normal operation of the plurality of suction valves; and a controller configured to:

monitor, using a sensor of the fluid pump, measurements of an operating parameter relating to the fluid pump;

detect, based on monitoring the measurements of the operating parameter, that the measurements of the operating parameter exhibit a signature or an anomaly indicative of a defect;

correlate, based on the measurements of the operating parameter, the defect to a cylinder of the respective cylinders using a timing wheel or a phase marker; and cause termination of discharge flow from the cylinder during one or more discharge cycles of the plurality of discharge cycles, while discharge flow from at least one other cylinder of the respective cylinders is maintained during the one or more discharge cycles.

17. The fluid pump system of claim 16, wherein the controller, to cause termination of discharge flow from the cylinder, is configured to:

cause a suction valve of the cylinder to be maintained in an open position throughout the one or more discharge cycles.

18. The fluid pump system of claim 17, further comprising a valve control component configured to control actuation of the suction valve, wherein the controller, to cause the suction valve to be maintained in the open position, is configured to:

cause the valve control component to maintain the suction valve in the open position.

19. The fluid pump system of claim 18, wherein the controller, to cause the valve control component to maintain the suction valve in the open position, is configured to:

cause actuation of the valve control component to an extended position to hold open the suction valve.

20. The fluid pump system of claim 16, further comprising a prime mover for the fluid pump, wherein the controller is configured to cause termination of discharge flow from the cylinder while the prime mover is in a non-stationary state.

* * * * *